US005740840A

United States Patent [19]

Lindahl

[11] Patent Number: 5,740,840

[45] Date of Patent: Apr. 21, 1998

[54] CONTROL OF HEALD FRAME MOVEMENT FOR CHANGING SHUTTLE CLEARANCE THROUGH A WEAVING SHED

[75] Inventor: Jan Karl-Gustav Lindahl, Geer, S.C.

[73] Assignee: Texo AB, Almhult, Sweden

[21] Appl. No.: 660,939

[22] Filed: Jun. 10, 1996

[30] Foreign Application Priority Data

Jun. 12, 1995 [SE] Sweden ..... 9502117-6

[51] Int. Cl.[6] ..... D03C 13/00

[52] U.S. Cl. ..... 139/55.1; 139/57

[58] Field of Search ..... 139/57, 55.1, 58

[56] References Cited

U.S. PATENT DOCUMENTS 4,337,801 7/1982 Suzuki et al. ..... 139/57
5,273,079 12/1993 Beyaert et al. ..... 139/57

FOREIGN PATENT DOCUMENTS 2097-944 5/1987 Japan ..... 139/55.1
2127-544 5/1990 Japan ..... 139/55.1
6 -65834 3/1994 Japan ..... 139/55.1

*Primary Examiner*—Andy Falik
*Attorney, Agent, or Firm*—Pollock, Vande Sande & Priddy

[57] ABSTRACT

A weaving machine includes a plurality of individually adjustable heald frames for forming an upper shed and lower shed by acting on warp threads. The heald frames are coordinately controllable by a control unit. At least one shuttle transports weft threads through the upper shed and lower shed. At least one shuttle path arranged under the warp threads forming the lower shed supports the at least one shuttle. The control unit controls movement of the heald frames effected by a position adjustable unit to bring about different upwardly and downwardly directed forces on the warp threads, depending upon a desired weaving design. The control unit adapts the forces applied to the warp threads of the lower shed to the shuttle path so as to provide the at least one shuttle with clearance through the upper shed and the lower shed that is substantially unaffected by the warp threads in spite of the respective force applied to the warp threads.

11 Claims, 7 Drawing Sheets

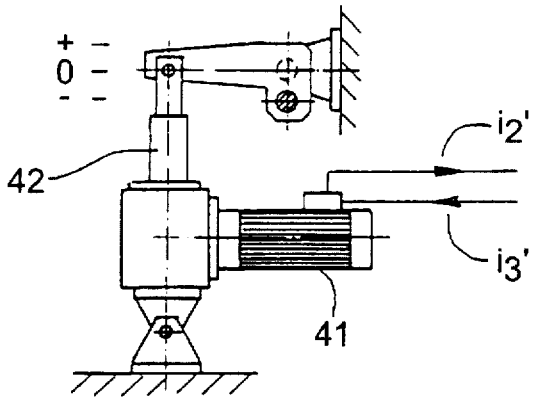
Fig. 5a
Fig. 5b
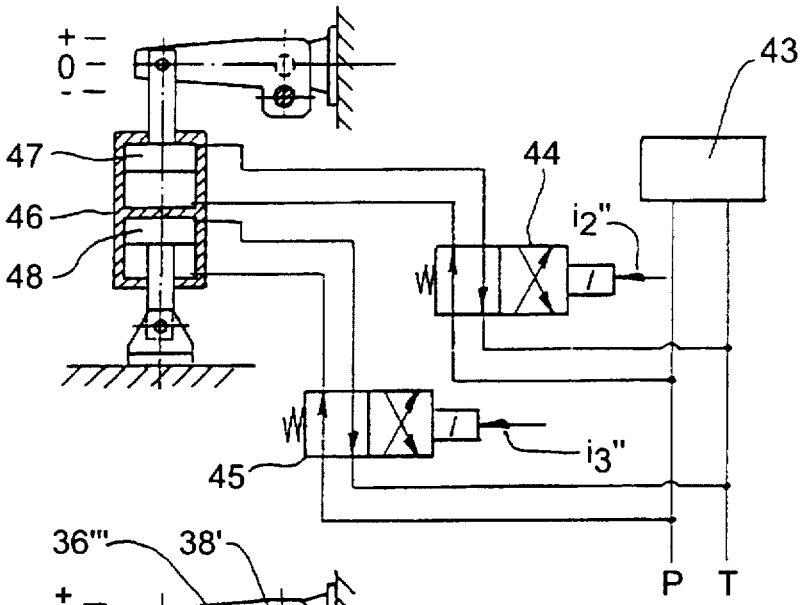
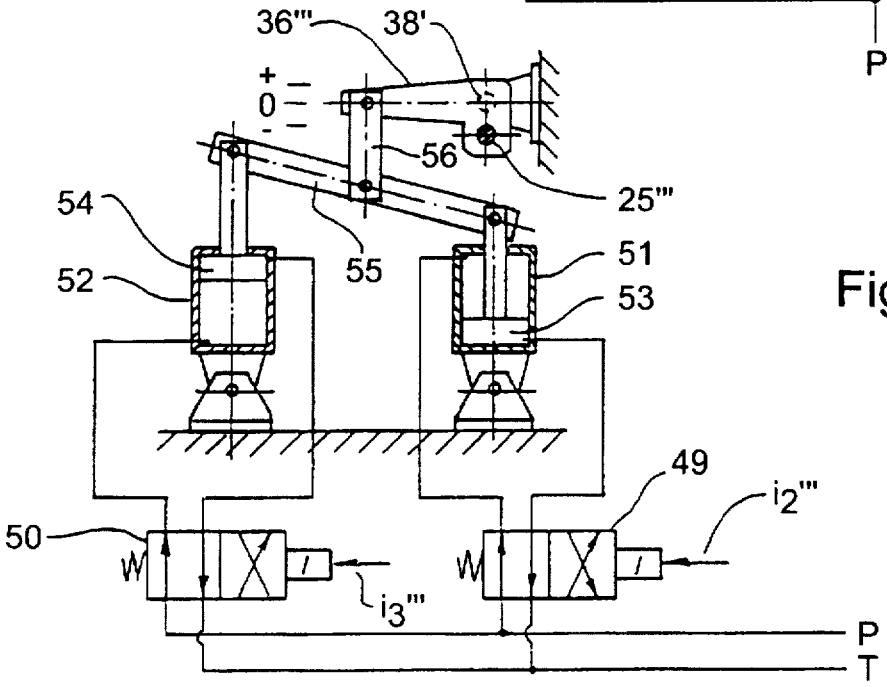
Fig. 5c

CONTROL OF HEALD FRAME MOVEMENT FOR CHANGING SHUTTLE CLEARANCE THROUGH A WEAVING SHED

FIELD OF THE INVENTION

The present invention relates to a weaving machine arrangement which works with warp threads which can be acted on by individually adjustable heald frames for forming upper and lower sheds. One or more shuttles can be shot through the sheds. On shooting through, the shuttles are supported by, or slide on with the warp threads inbetween, one or more shuttle paths situated under the warp threads of the lower shed. The individual adjustments of the heald frames can be controlled by a control unit which brings about the individual heald frame adjustments depending on a weaving design. The weaving machine is, in this case, the type in which the individual heald frame adjustments bring about different upwardly or downwardly directed resultant forces on the warp threads.

The invention also relates to an arrangement for, in weaving machines which carry out multilayer weaving, bringing about improved stacking of waft threads situated one above another in the finished weave. The weaving machine works, in this case, with warp threads which can be acted on by heald frames for forming upper and lower sheds as described above. One or more shuttles can be shot through the sheds, in which they are supported by one or more shuttle paths arranged under the warp threads of the respective lower shed.

The invention can be used, in particular, in shuttle machines in which the warp threads run between a tension beam arrangement and a breast beam, or breast beam strip arrangement and the heald frames or the heald frame assembly is/are arranged between the arrangements. In such a weaving machines, a shuttle and reed, as well as the beating-up edge in the woven material, are also arranged between the heald frames and the breast beam or breast beam strip arrangement. The heald frames are acted on in a known manner by a heald frame adjusting machine which brings about upwardly and downwardly directed movements of the heald frames depending on information obtained from the weaving design program used or equivalent.

The upwardly and downwardly directed movements of the heald frames lead to the warp threads being drawn upwards and downwards depending, upon the obtained information. In this manner, upper sheds and lower sheds are formed, within which one or more shuttles are shot through during each weaving machine stroke. The shuttles draw with them waft threads which are to run essentially at right angles to the warp thread directions.

Examples of such weaving machines are shuttle machines TM-300 and TM-400 sold by TEXO AB, Almhult, Sweden, for weaving wires and similar material.

BACKGROUND OF THE INVENTION

It is a well-known problem that forces caused by the heald frames during shed formation can give rise to upwardly or downwardly directed resultant forces on the portions of the warp threads between tension beam and breast beam or breast beam strip arrangements. The resultant forces during each shed formation are due to a greater number of heald frames being drawn upwards than downwards, or vice versa. The resultant forces lead to the warp thread portions as a whole being drawn upwards or downwards. These movements in the warp thread portions can, to a certain extent, be counteracted by increased warp thread tension, which is determined by the tension beam arrangement.

However, the warp thread tension can be raised only to a certain value because of limitations in the strength of the warp threads. Furthermore, energy consumption in the weaving machine and the wear in the components of the weaving machine which are involved must be considered. The resultant forces thus lead to the beating-up edge being displaced upwards or downwards in relation to an ideal position for optimum quality. The ideal position coincides with a horizontal plane, or other comparable plane, through the beating-up edge when the resultant forces on the warp threads are zero. The resultant forces and the upwardly or downwardly directed movements they cause in the warp thread portions, also lead to a lifting or pressing of the warp threads of each lower shed against the shuttle path and to the displacement of the shed in relation to the shuttle box positions or to the size of the shed being inadequate for shuttles which have been shut off.

SUMMARY OF THE INVENTION

The purpose of the present invention is to propose an arrangement which solves these problems.

In the case of upwardly directed resultant forces, the threads of the lower shed are lifted up from the shuttle path(s) and the shuttle is interfered with in its passage through the shed. In the worst case, the shuttle may jump out of the shed (between the threads) and cause personal injury or other harm. Wear also occurs on the warp threads when the shuttle runs directly on the threads without a stable base provided by the shuttle path.

In the case of downwardly directed resultant forces, a lowering of the beating-up edge is brought about. Lowering of the leading edge leads to the warp threads of the upper shed having an angle other than the ideal angle and causes lowering of the position of the warp threads along the reed. That is to say, the clearance for the shuttle is considerably reduced. In certain cases, this can lead to the warp threads catching in the upper edge of the shuttle, which, as discussed above, can cause operational problems with undesirable stops and undue wear on the warp threads. The invention solves this problem also.

There is a need for the invention to be usable both on weaving machines which have already been manufactured and installed and on newly manufactured weaving machines. This makes demands for easily applicable functions which can be introduced into the weaving machine without too extensive rebuilding and new construction. The present invention solves this problem also.

There is also a desire that the new functions be implemented by simple functional modification of existing components in the weaving machine. This also is solved by the present invention.

A further problem the invention solves is speeding up and making more efficient the transfer of each shuttle from one side of the machine to the other and vice versa.

In connection with weaving multilayer material, the need exists to achieve a desired accuracy in the stacking of weft threads which, in the finished woven material, are placed one above another or essentially one above another in a predetermined manner. The present invention aims to solve this problem also.

The present invention is mainly characterized in that the heald frames are arranged for common or coordinated controllability from the control unit, weaving design etc. In each common control effected, adaptation takes place of the warp threads of the lower shed to the respective shuttle path so that on each shooting-through each shuttle has a passage or clearance through upper and lower sheds which is essentially unaffected by the warp threads in spite of the respective resultant force.

In a preferred embodiment, each adjustment of the heald frames, or the heald frame assembly, for each shuttle shot is arranged to take place in a first stage or time stage, of the adjustment phase. The common or coordinated adjustment of the heald frames or the heald frame assembly is arranged to take place in a second stage of the adjustment phase of the heald frames.

In an embodiment of the invention, use is made of an intermediate lever shaft, on which intermediate levers are rotatably mounted. On each shot, the intermediate levers receive their rotary positions from a heald frame adjusting machine and in turn transmit their adjusted positions via pull rods to levers acting on the vertical adjustments of the heald frames. The common or coordinated adjustment of all heald frames or the heald frame assembly can be effected by a displacement movement of the bearing of the intermediate lever shaft. In one embodiment, this displacement movement can be effected by a lever arrangement which can be controlled by an AC servomotor or a hydraulic arrangement.

The main characteristic of an arrangement for bringing about improved or more predictable stacking of weft threads situated one above another in the weave generated by the weaving machine is that, on each shot or weaving machine stroke, the entire heald frame assembly can be acted on by a common or coordinated control when the individual adjustments of the heald frames in the assembly bring about an upwardly or downwardly directed resultant force. With such a control effected, the heald frame assembly or the heald frames adapt(s) to the respective shuttle path concerned with differential tensions in the warp threads of the upper and lower sheds. The differential tensions contribute to the improved stacking. When the heald frame assembly is raised relative to the shuttle path, the warp threads of the upper shed are more tensioned than the warp-threads of the lower shed and vice versa.

The present invention, keeps down the warp thread tension in the weaving machine, which in turn leads to reduced wear on the involved components of the weaving machine and also to the reduction of the energy consumption. The invention can be introduced into new production. It can also be implemented easily in weaving machines which already exist since only small functional modifications have to be made in an existing arrangement and existing control functions. The shuttles can perform their movements between the two sides of the machine (the weave) without delays as a result of friction against the warp threads.

BRIEF DESCRIPTION OF THE DRAWINGS

A presently proposed embodiment of an arrangement which has the characteristics which are significant of the invention is to be described below with simultaneous reference to the attached drawings, in which

FIGS. 5*a*–5*c* show in a basic diagrammatic form actuating components of the equipment according to FIG. 4;

DETAILED DESCRIPTION OF VARIOUS AND PREFERRED EMBODIMENT(S)

Figure 1:
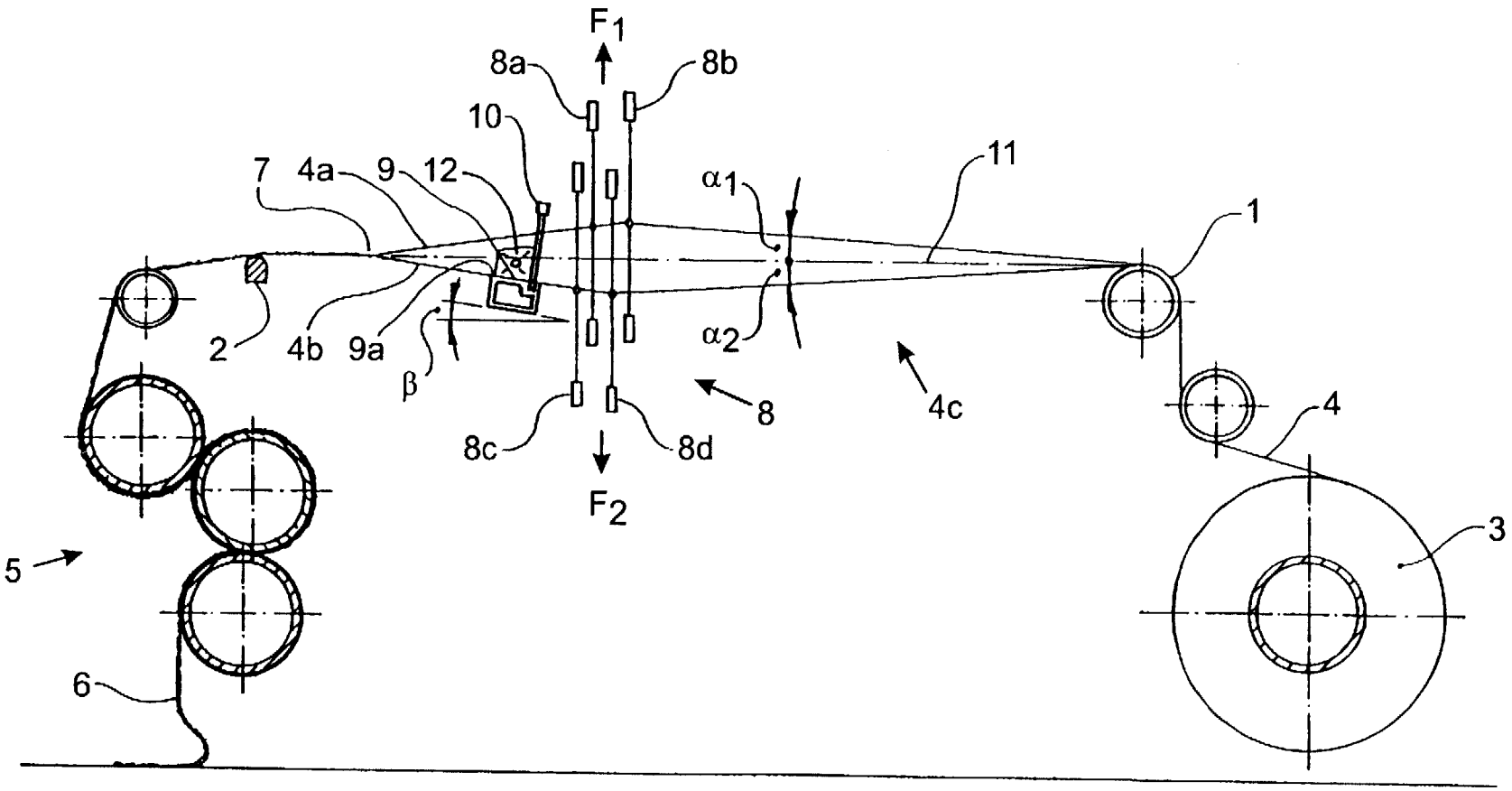
FIGS. 1–3 show in a vertical cross-section various functional states in a previously known weaving machine.

In FIG. 1, a tension beam is shown as 1 and a breast beam strip as 2. A number of parallel warp threads 4 leave a warp thread magazine 3. A front roller arrangement is shown as 5 and finished weave as 6. The beating-up edge or fell of the woven material is indicated by 7. A heald frame assembly is shown by 8 and a shuttle path by 9. A reed or a comb arrangement is designated as 10. The shuttle path 9 and the reed arrangement 10 are arranged, or work between the heald frame assembly and the strip 2. In the embodiment shown, in the heald frame assembly, two heald frames **8*a* and 8*b* have been actuated into their upper positions and two heald frames 8*c* and 8*d* have been actuated into their lower positions so that an upper shed 4*a* and a lower shed 4*b* have been formed. A horizontal plane 11 extends at right angles to the plane of the paper. A shuttle is shown as 12**.

The heald frames **8*a* and 8*b* cause a force F1 and the frames 8*c* and 8*d* cause a force F2 on warp thread portions 4*c* between the tension beam 1 and the strip 2. By virtue of the fact that the same number of heald frames are acted on upwards and downwards, the resultant force F1–F2=0 on the warp threads. This results in the beating-up edge 7 being situated in or essentially in the horizontal place 11. The upper and lower sheds are symmetrical in this case, which is indicated by the fact that the angle $\alpha 1$ equals the angle $\alpha 2$. The top surface 9*a* of the shuttle path is inclined at an angle $\beta$ in the plane of the paper. The inclination corresponds to the inclination of the warp threads 4*b* of the lower shed leading to the top surface 9*a*, the warp threads of the lower shed running parallel, and the warp threads smoothly adjoin the top surface 9*a*. This leads to the respective shuttle being able to slide on the inside of the warp threads of the lower shed at the same time as it receives support from the top surface 9*a* of the shuttle path. The shed 4*a*, 4*b* is optimally open and the shuttle 12 can have an interference-free passage clearance through the shed 4*a*, 4*b***.

Figure 2:
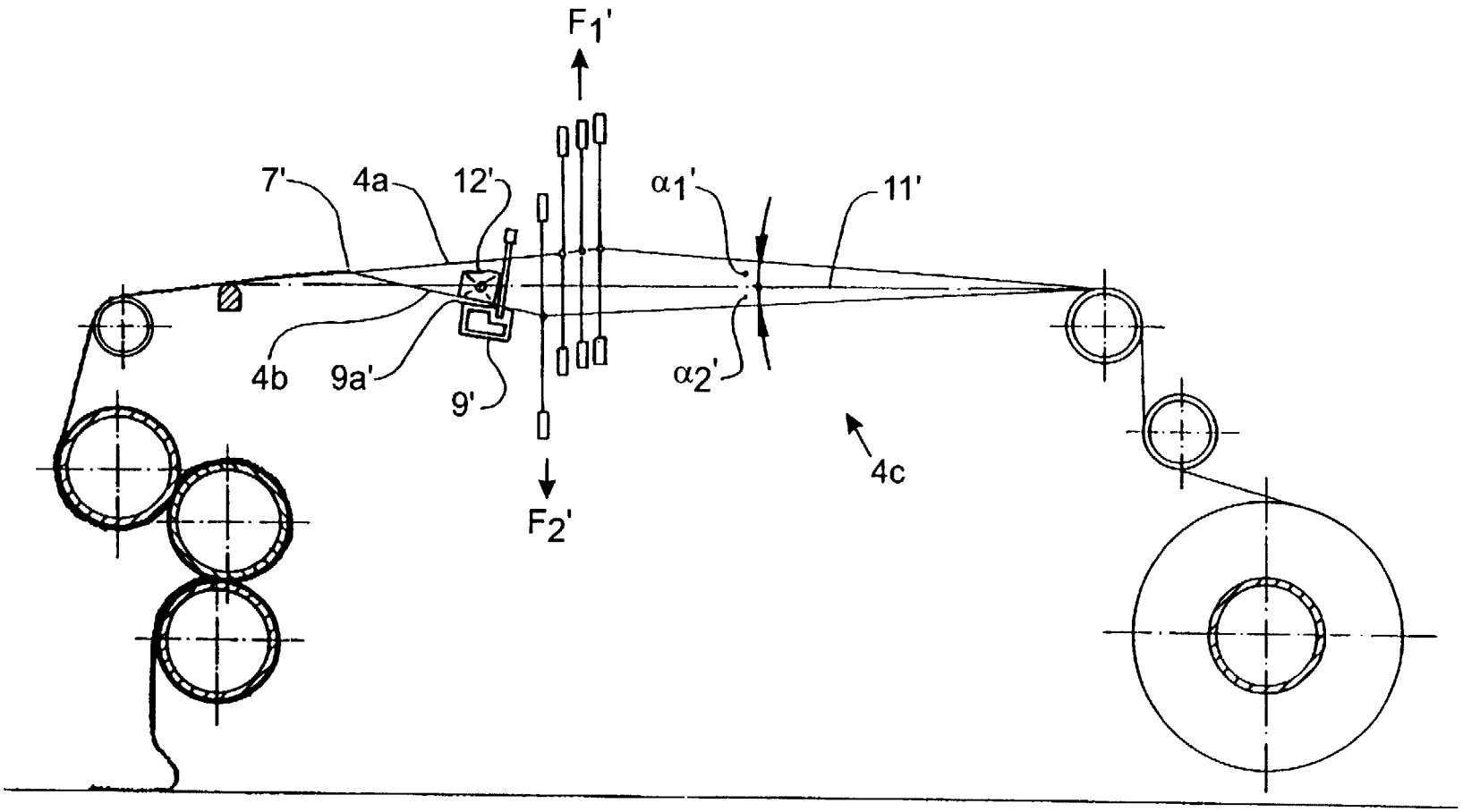

In the functional state shown in FIG. 2, with three upwardly drawn heald frames and one downwardly drawn heald frame, the upwardly directed force F1' is greater than the downwardly directed force F2'. This leads to the portions **4*c* of the warp threads 4 being lifted upwards in FIG. 2, that is to say away from the shuttle path 9'. The angles according to the invention $\alpha 1'$ and $\alpha 2'$ of the sheds 4*a* and 4*b* have different sizes. Also, the beating-up edge 7' is raised above the horizontal plane 11'**. This leads to asymmetry in the shed formation.

The discrepancy in the shed formation, and the fact that the warp threads of the lower shed are lifted from the surface **9*a'*** and inclined in relation to this in the plane of the paper and also that the position of the shuttle box is slightly displaced vertically in relation to the shed lead to the possibility of interference with the entry of the shuttle into the shed. Major disruptions can then arise and cause undulations of the shuttle, which as a result may leave the shed.

Figure 3:
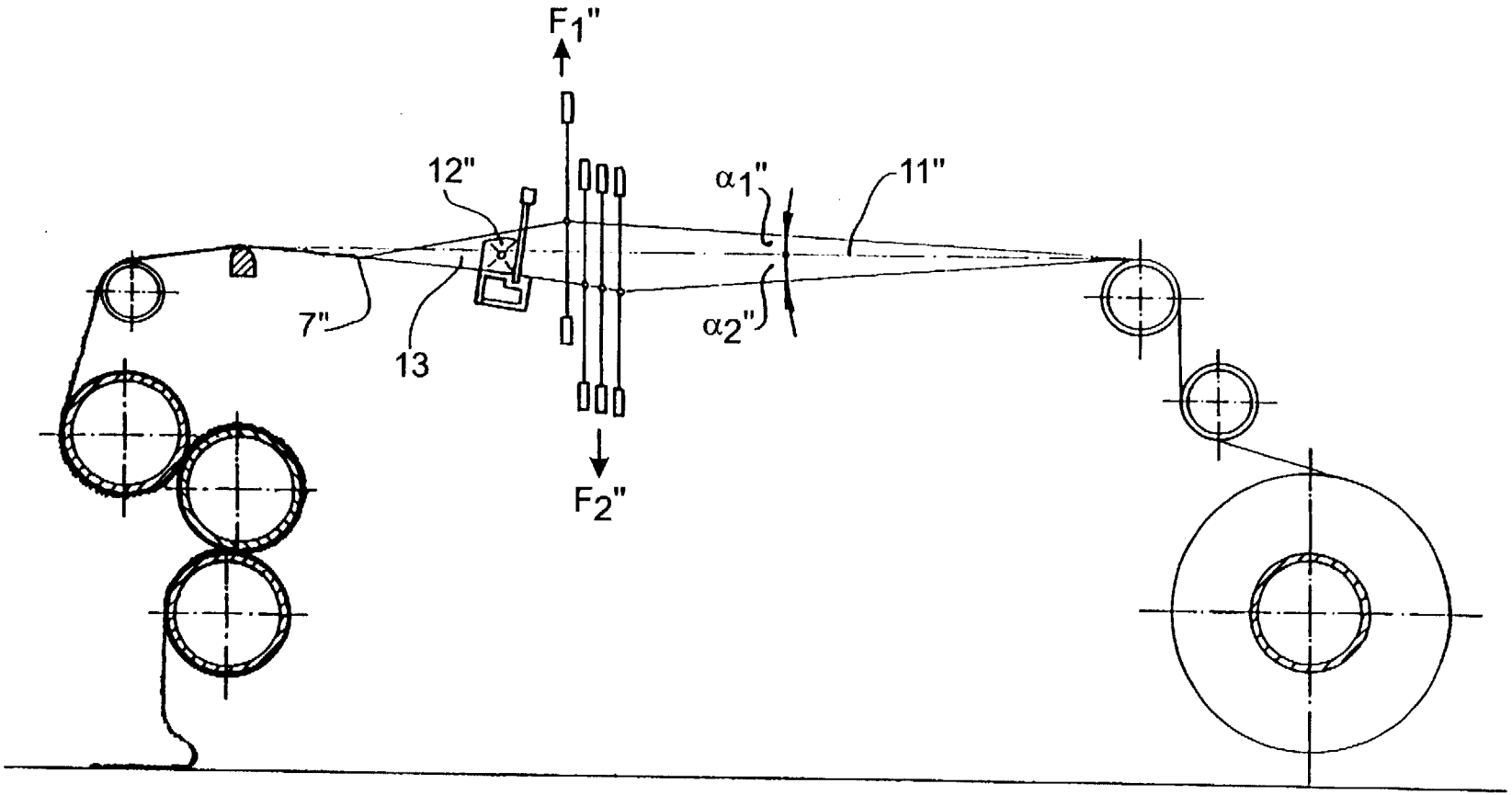

In the case according to FIG. 3 with one upwardly drawn and three downwardly drawn heald frames, the force F2" exceeds the force F1", leading to the warp threads of the lower shed being pressed down against the shuttle path. In this case also, asymmetry arises in the shed formation, such that $\alpha 2'' > \alpha 1''$. The beating-up edge 7" is lowered below the horizontal plane 11" and the vertical space 13 in the shed part concerned is reduced. These changes lead to risks of the upper parts of the shuttle knocking against the warp threads in the upper shed. Knocking of the shuttle interferes with the clearance of the shuttle and can cause undesirable stops in weaving and/or undesirable wear of the warp threads.

Figure 4:
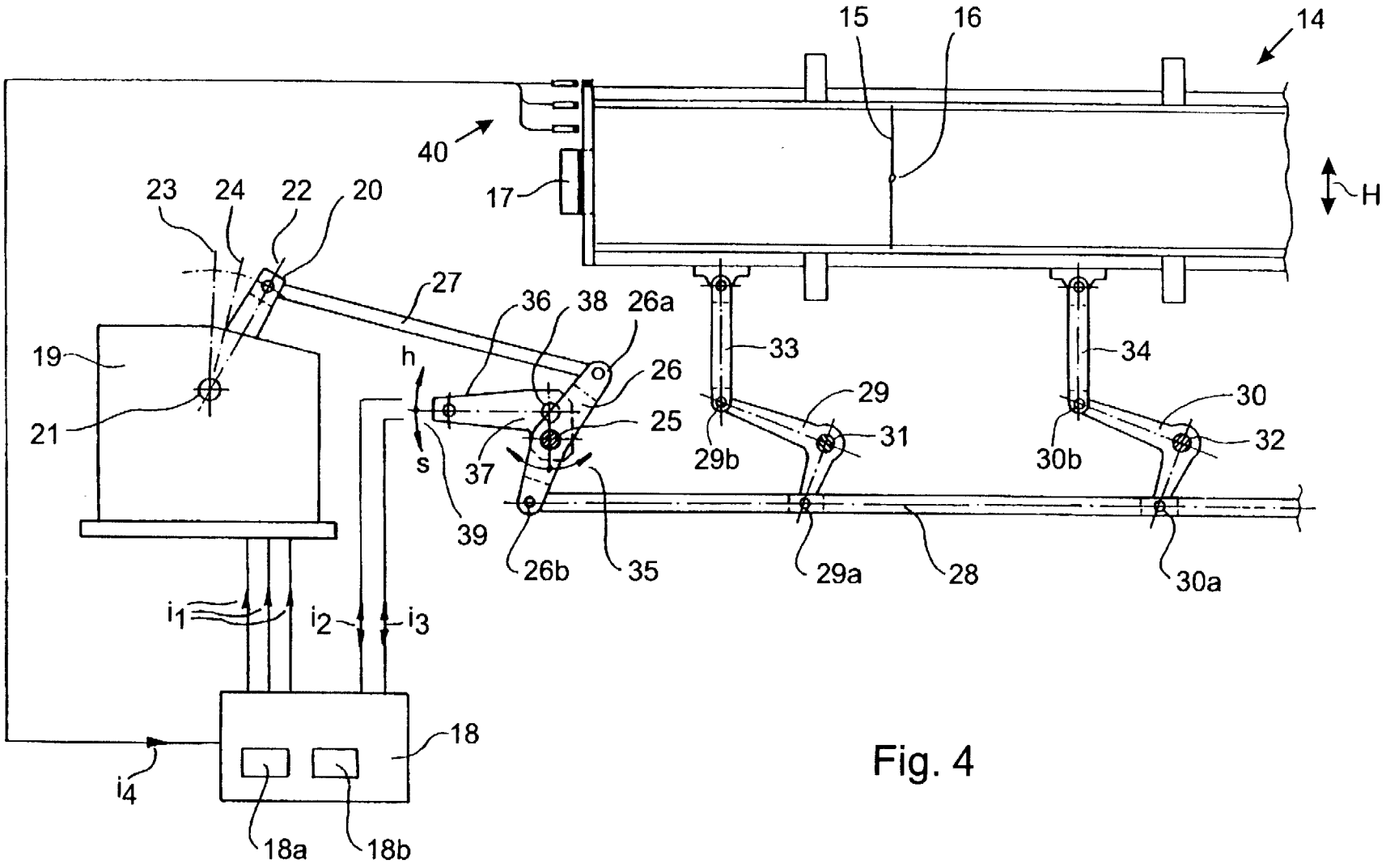
FIG. 4 shows in a longitudinal section parts of a weaving machine which includes equipment acting on the heald frames according to the present invention.

FIG. 4 shows examples of individual and common or coordinated control of the heald frames in the heald frame assembly which is represented by 14. Each frame has a heddle 15 for a warp thread 16. The heald frames/the heald frame assembly can be mounted with a bearing function represented by 17 which contributes to controlling of the lateral movement of the frames.

The weaving machine can, in a known manner, comprise a control unit (computer) 18 which is arranged to generate signals i1 to a heald frame adjusting machine 19. Also in a known manner, the adjusting machine generates the individual vertical movements of the heald frames. Each heald frame can be actuated from a central position to an upper or lower shed position. This is effected by an actuating arm 20, belonging to each heald frame, in the heald frame adjusting machine being actuated in a known manner. The arm is arranged rotatably around a center 21. Actuation can take place into an upper shed position 22 or a lower shed position 23. A central position 24 has also been indicated for each arm 20.

The individual actuation of each heald frame by the heald frame adjusting machine is effected by a linkage arrangement which comprises intermediate levers 26 (one for each heald frame) mounted on an intermediate lever shaft 25. The intermediate levers 26 are connected to the heald frame adjusting machine via an actuating rod 27 which is connected to the end 26*a* of each intermediate lever 26. The end 26*b* of the intermediate lever is connected to a pull rod 28.

Also included are further levers 29, 30 which are mounted rotatably on shafts 31 and 32, respectively. A number of, for example 2–15, such levers 29, 30 are assigned to a heald frame in order to ensure its parallel displacement in the vertical direction H. The levers 29, 30 are connected via their first ends 29*a*, 30*a* to the pull rod 28 and via their second ends 29*b*, 30*b* to rods 33, 34, which are in turn connected or fixed to the associated heald frame.

The arrangement is, in this case, such that the heald frames, for example 24 heald frames, can be individually adjusted in their upper or lower shed positions depending on control signals i1 generated depending on a weaving program 18*a* which is included in the control unit 18 or connected to the control unit 18. The control unit is also shown with an actuating unit 18*b* which can comprise keys or actuating members for adjusting various functions in the weaving machine. Each heald frame is assigned, for its maneuvering, the transmission linkage 21–34 shown in FIG. 4. There are thus 24 such transmission linkages in the case with 24 heald frames.

For the common or coordinated control of the heald frames, the intermediate lever shaft 25 is mounted displaceably in the directions of the arrows 35. This displaceability is brought about by maneuvering members/maneuvering arms 36 included in a unit 37 which also supports the bearing for the intermediate lever shaft 25. The unit 37 is rotatably mounted on a shaft 38. When the maneuvering arm 36 is actuated in the directions of the arrows 39, the common coordinated movements concerned of all the heald frames in the heald frame assembly are effected.

In the present case with 24 heald frames, all 24 heald frames are thus actuated simultaneously in a coordinated manner. The maneuvering members 36 have been, in the case according to FIG. 4, assigned two distinct positions "low" s and "high" h. Of course, several stepwise adjustments can be brought about and stepless actuation of the maneuvering members 36 can likewise take place so that a number of actuating positions can be obtained for the maneuvering members.

The actuation itself of the maneuvering members takes place by means of signals i2, i3 which can be generated by the control unit 18. The signals are determined in one embodiment with the aid of the weaving design program 18*a*. The generation of the signals i2 and i3 can take place in a known manner (see generation of the signals il).

FIG. 4 also shows transmitter members 40. The transmitter member(s) can, for example, sense the actuating force in the heald frame(s)/warp thread(s) affected, and send one or more signals i4 corresponding to the force, back to the control unit. The control unit can receive such feedback signals from one or more heald frames in the heald frame assembly. The signal or signals i4 can also represent the respective resultant force in each heald frame adjustment.

FIGS. 5*a*–5*c* show various actuating members for adjusting maneuvering members/maneuvering arms 36, 36', 36". The embodiment shown in FIG. 5*a* includes an AC servomotor 41 and associated ball screw 42 for adjusting by steps. For example, the adjustment may include three steps which correspond to the central position and the upper and lower shed positions. Alternatively, the adjustment may include more than three steps.

A further alternative includes stepless adjustment for the vertical adjustment position or adaptation position of the heald frames/heald frame assembly in relation to the shuttle path. Compare this embodiment to the above. Examples of an AC motor and a ball screw include SEIDEL and STAR, respectively. The maneuvering signals i3', i2' can be used to control the AC servomotor in a known manner.

The embodiment shown in FIG. 5*b* utilizes an electric hydraulic arrangement in which a hydraulic source is indicated by 43. Also included in the arrangement are control valves 44, 45 and a hydraulic cylinder 46 with double piston 47, 48 with associated piston rods. The control valves 44, 45 are controlled by the signals i2", i3" depending on the weaving design or equivalent. In this case also, three positions are possible, a central position and two outer positions which correspond to the upper and lower shed positions. In FIG. 5*b*, the pressure line is represented by P and the drain (tank) by T.

The embodiment shown in FIG. 5*c* utilizes an alternative hydraulic arrangement for acting on the maneuvering member 36"' so that the shaft 25"' is turned around the bearing shaft 38'. Included in this embodiment are also two control valves 49, 50 which are actuated with the aid of the signals i2"' and i3"'. Also included are two hydraulic cylinder arrangements 51 and 52. Each arrangement comprises a piston 53 and 54 respectively with associated piston rod. The piston rods are connected to a lever 55 which is mounted via its central parts on an actuating rod 56 which is fixed to the end of the maneuvering member 36"'. With the arrangement, three distinct adjustment steps are obtained, a central position and two outer positions which correspond to the upper and lower shed positions. In this case also, P and T lines are included. Compare this to the above.

Figure 6:
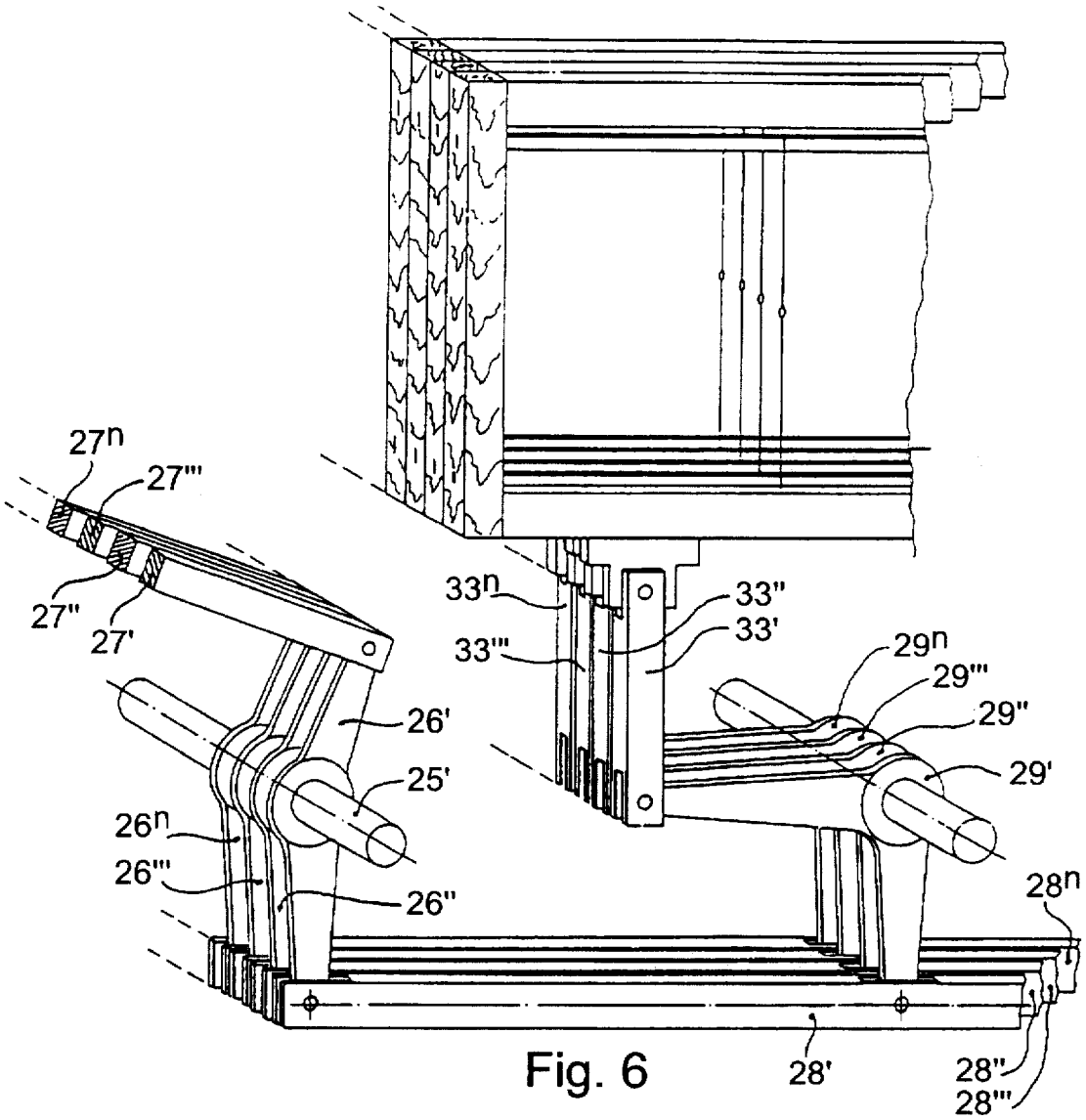
FIGS. 6–6*a* show in perspective parts of the equipment according to FIG. 4.
Figure 6A:
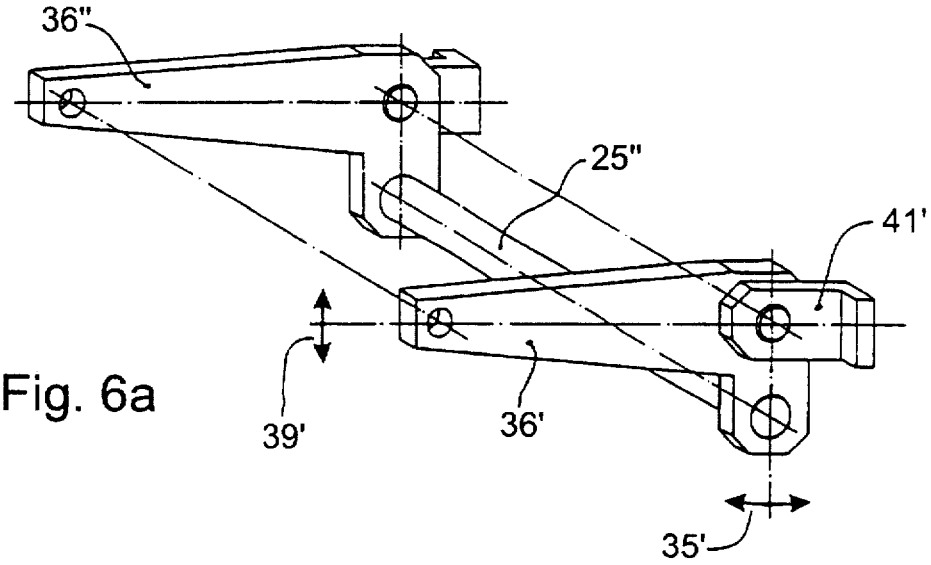

FIGS. 6 and 6*a* show the multiplicity of the movement transmissions from the heald frame adjusting machine to the heald frames. A shaft 25', 25" is included and is mounted in bearing members 41' (see FIG. 6*a*) for receiving the movement 35' by means of the movements 39'. Also included are two maneuvering members or maneuvering arms 36' and 36" respectively. The number of intermediate levers 26' corresponds to the number of heald frames. This also applies for the actuating rods 27', 27" from the heald frame adjusting machine. The multiplicity also exists for the pull rods 28', 28", 28"', 28*n* and the levers 29', 29", 29"' and the actuating rods 33', 33", 33"', 33*n*.

Figure 7:
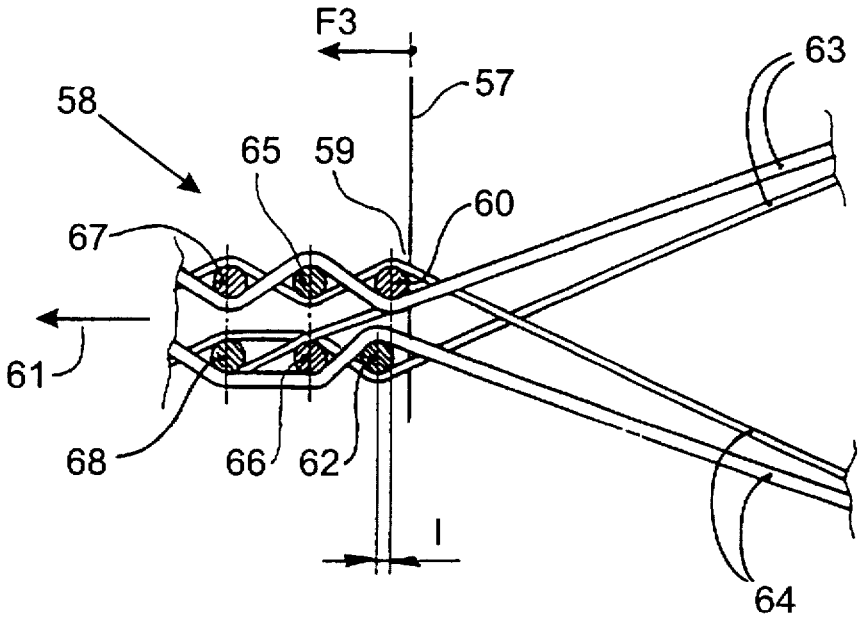
FIG. 7 shows in a cross-section two examples of a weave shape in which further advantages are achieved with the new arrangement.

FIG. 7 shows a stacking function for double or multilayer weaving improved relative to known stacking functions. The reference 57 symbolizes the beating-up position for a reed which is actuated against the beating-up edge 59 of the weave 58 with a force F3. It can be seen that the reed can displace the uppermost weft thread 60 in the weave according to FIG. 7 in the direction of movement 61 of the weave more than the underlying weft thread 62 when the tension in the warp threads 63 of the upper shed exceeds the tension in the warp threads 64 of the lower shed. A distance 1 can, in such a manner, be essentially eliminated so that the threads 60, 62 will lie one above another when the reed stroke has been completed. In comparison, the threads 65, 66 and 67, 68, respectively, lie one above another in the double weave. The displacement 1 of the positions of the waft threads is caused by the shooting in of the threads 60, 62 not taking place simultaneously and by the weave being fed essentially continuously. The waft thread which is least tensioned by the warp threads can thus be acted upon with a greater movement and vice versa.

The invention is not limited to the embodiment described above as an example, but can be subjected to modifications within the scope of the patent claims below and the inventive idea.

I claim:

1. A weaving machine, comprising:

a plurality of individually adjustable heald frames for forming an upper shed and a lower shed by acting on warp threads, said heald frames being coordinately controllable by a control unit;

at least one shuttle for transporting weft threads through the upper shed and the lower shed;

at least one shuttle path, arranged under the warp threads forming the lower shed, for supporting said at least one shuttle; and said control unit for controlling movement of said heald frames to bring about different upwardly or downwardly directed forces on the warp threads depending upon a desired weaving design, said control unit adapting the forces applied to the warp threads of the lower shed to the shuttle path to provide said at least one shuttle with clearance through the upper shed and the lower shed that is substantially unaffected by the warp threads in spite of the force applied to the warp threads.

2. A weaving machine according to claim 1, wherein said control unit controls adjustment of said heald frames in a first stage for transportation of the shuttle through the upper shed and the lower shed and in a second stage for coordinated adjustment of the heald frames.

3. A weaving machine according to claim 1, further comprising:

an intermediate lever shaft;

a plurality of individually controllable intermediate levers interconnected with the heald frames and rotatably mounted on said intermediate lever shaft;

a heald frame adjusting machine interconnected with said intermediate levers for individually controlling rotary movement of said intermediate levers;

a plurality of pull rods interconnected with said intermediate levers for transmitting adjusted positions of said intermediate levers; and a plurality of levers interconnected with said pull rods and said heald frames for receiving said adjusted positions of said intermediate levers and vertically adjusting said heald frames; and wherein a displacement of said intermediate lever shaft effects a common, coordinated adjustment of said heald frames.

4. A weaving machine according to claim 3, further comprising:

a lever arrangement interconnected with said intermediate lever shaft for affecting the displacement of said intermediate lever shaft.

5. A weaving machine according to claim 4, further comprising:

an AC servo motor or hydraulic system interconnected with said lever arrangement for actuating said lever arrangement.

6. A weaving machine according to claim 5, wherein said control unit further controls the displacement of the intermediate lever shaft by generating control signals for said AC servo motor or said hydraulic system.

7. A weaving machine according to claim 1, wherein the controlled movement of the heald frames ensures that a beating up edge of a material woven by said weaving machine will have a substantially similar horizontal position to a horizontal plane passing through the boundary between the upper shed and the lower shed and the beating up edge.

8. A weaving machine according to claim 1, further a position adjustable unit adjustable into a plurality of positions for effecting the movement of said heald frames, said unit comprising:

rotatable angled parts;

a control shaft;

bearing members for rotatably mounting said unit; and bearing members on one of the rotatable angled parts for bearing said control shaft;

wherein said bearing members for rotatably mounting the unit differ from the bearing members for the control shaft.

9. A weaving machine for forming a multi-layer weave and for improved stacking of weft threads arranged above each other in the multi-layer weave, said weaving machine comprising:

a plurality of heald frames for forming an upper shed and a lower shed by acting on warp threads;

at least one shuttle for transporting weft threads through the upper shed and the lower shed;

at least one shuttle path arranged under the warp threads forming the lower shed for supporting said at least one shuttle; and a control unit for controlling movement of said heald frames, wherein adjustments of individual heald frames bring about an upwardly directed or a downwardly directed force on the warp threads such that said control unit adapts the forces applied to the warp threads of the lower shed to provide said at least one shuttle with clearance through the upper shed and the lower shed that is substantially unaffected by the warp threads in spite of the respective force applied to the warp threads.

10. A weaving machine according to claim 9, wherein when said heald frames are raised relative to the shuttle path by a position adjustable unit, a greater tension is created in the warp threads of the upper shed than the warp threads of the lower shed, the greater thread tension producing upon a beating up by a reed a reduced weft thread movement in a forward direction of the weave produced by the machine relative to a weft thread movement in the warp threads of the lower shed.

11. A weaving machine according to claim 9, wherein when said heald frames are raised relative to the shuttle path by a position adjustable unit, a greater tension is created in the warp threads of the lower shed than the warp threads of the upper shed, the greater thread tension producing upon a beating up by a reed a reduced weft thread movement in a forward direction of the weave produced by the machine relative to a weft thread movement in the warp threads of the upper shed.

* * * * *

UNITED STATES PATENT AND TRADEMARK OFFICE

CERTIFICATE OF CORRECTION

PATENT NO. : 5,740,840
DATED : April 21, 1998
INVENTOR(S) : Lindahl

It is certified that error appears in the above-indentified patent and that said Letters Patent is hereby corrected as shown below:

On the Title page:
Item [75] Inventor: - Change "Geer, S.C." to --Greer, S.C.--.

Signed and Sealed this

Seventh Day of July, 1998

Bruce Lehman

*Attest:*

BRUCE LEHMAN

*Attesting Officer*

*Commissioner of Patents and Trademarks*